420-455 SR
9/15/86 OR 4,612,164

United States Patent [19]
Ramsey et al.

[11] Patent Number: 4,612,164
[45] Date of Patent: Sep. 16, 1986

[54] NICKEL COPPER ALLOYS WITH ENHANCED MALLEABILITY AND IMPROVED SULFIDE DISTRIBUTION

[75] Inventors: Cecil L. Ramsey; Francis S. Suarez, both of Huntington, W. Va.

[73] Assignee: Inco Alloys International, Inc., Huntington, W. Va.

[21] Appl. No.: 667,010

[22] Filed: Nov. 1, 1984

[51] Int. Cl.[4] ..... C22C 19/03; C22C 9/06
[52] U.S. Cl. ..... 420/455; 420/485; 420/487
[58] Field of Search ..... 420/455, 457, 458, 459, 420/485, 487; 148/426, 435

[56] References Cited

U.S. PATENT DOCUMENTS

| | | | |
|---|---|---|---|
| 2,150,094 | 3/1939 | Bieber | 420/457 |
| 2,586,768 | 2/1952 | Bash | 420/455 |
| 3,853,540 | 12/1974 | Schlatter et al. | 75/58 |
| 3,891,425 | 6/1975 | McCarty | 75/58 |
| 3,984,233 | 10/1976 | Easwaran et al. | 75/58 |
| 4,007,038 | 2/1977 | Deverell | 75/128 E |
| 4,018,597 | 4/1977 | Staggers | 420/578 |
| 4,035,892 | 7/1977 | Ototani et al. | 75/58 |
| 4,049,470 | 9/1977 | Burton | 420/441 |
| 4,121,924 | 10/1978 | deBarbadillo, II | 420/455 |
| 4,209,325 | 6/1980 | Cooper et al. | 75/257 |

OTHER PUBLICATIONS

Rare Metals Handbook, 2nd Ed., Hampel, pp. 410–417.
Non-Ferrous Melting Practice, AIME Symp., 74–78 (1946).
Alloying of Cr-Ni-Mo steels by Rare Earth Metals, Chem Abst. vol. 71-5732r, 1969.
Effect of Cerium Additions on the Plasticity of Ni and its Alloys at Elevated Temperatures-Chem. Abst., vol. 63-12805h-12806d, 1965.

*Primary Examiner*—R. Dean
*Attorney, Agent, or Firm*—Raymond J. Kenny

[57] ABSTRACT

Malleability and resistance to cracking of alloys containing nickel, copper, sulfur, etc. are enhanced through the co-presence of cerium and magnesium.

5 Claims, No Drawings

NICKEL COPPER ALLOYS WITH ENHANCED MALLEABILITY AND IMPROVED SULFIDE DISTRIBUTION

The present invention is directed to nickel-copper alloys, and more particularly to a novel nickel-copper alloy characterized by a desired sulfide morphology by virtue of which the alloy resists detrimental cracking upon subsequent hot and/or cold working, the alloy also being characterized by enhanced malleability.

BACKGROUND OF INVENTION

As is well known in the art, nickel-copper alloys have been used in sundry, diverse applications for decades. A number of such materials contain sulfur, a constituent often deemed subversive depending upon the intended application. However, recourse is found in the use of sulfur where excellent machinability characteristics are required, an operation which can be otherwise markedly expensive if difficult to perform. As a consequence, there are specifications, including specifications of Defense Procurement Agencies, e.g., QQ-N-281 (Class B), which require the presence of minimum sulfur levels, e.g., 0.025%.

As above indicated, sulfur can detract from properties since in nickel-copper alloys it is causative of forming nickel sulfide, an embrittling phase. To offset this, magnesium is used to transform the sulfur from an embrittling NiS grain boundary film into a less harmful globular magnesium sulfide (MgS) precipitate. However, as beneficial as magnesium may be, MgS tends to excessively plastic at conventional hot working temperatures, say 1800° F. to 2200° F. Apparently, the magnesium sulfide results in the formation of what are termed in the art as elongated "stringers". Put another way, upon hot working these elongated stringers form as opposed to discrete particles, i.e., the hot rolling does not sufficiently break up the stringers into particles. By reason of this, during hot working and/or upon subsequent cold working, undesirable cracking ensues leading to "material rejects".

The problem has manifested itself, for example, in the production of fasteners such as hexagonal nuts. In the production of such end products alloy material is upset forged, sliced to short lengths, hole punched and then threaded. In forming the hexagonal nuts troublesome cracking has been encountered on the outside diameter of the nuts leading to excessive rejects which, in turn, lead to unnecessarily higher production costs.

Sulfur removal might prove a panacea and this could possibly be accomplished by, inter alia, flux smelting. But the presence of sulfur is necessary for machinability applications. Accordingly, the problem was one of retaining the benefits of sulfur in respect of the machinability of nickel-copper alloys while minimizing the "stringers" adverse affect such that the alloys could be both hot and cold worked without excessive cracking.

THE INVENTION

It has now been found that the problem above-described can be substantially minimized, if not completely eliminated, through the co-addition of cerium and magnesium to sulfur-containing copper nickel alloys as set forth infra. It would appear that greatly less elongated sulfide stringers result which markedly reduce or obviate the cause of cracking during working.

INVENTION EMBODIMENTS

Generally speaking, the present invention contemplates minimizing cracking in alloys containing nickel, copper and sulfur through the co-presence of magnesium and cerium. In accordance herewith, the magnesium and cerium are present in small but effective amounts sufficient to enhance cracking resistance when the alloy is hot and cold worked. It is preferred that at least 0.01%, advantageously, 0.02%, cerium be present together with at least 0.01 or 0.015%, advantageously 0.025%, magnesium. It is not necessary that the retained levels of cerium and magnesium exceed 0.05% and 0.1%, respectively. Good results have been achieved on commercial size heats with percentages not exceeding 0.025% cerium and 0.05% magnesium. Put another way, in terms of the cerium content enough should be present to otherwise convert an appreciable amount of stringers that would have formed in the absence of cerium to a more globular-like form.

Apart from the foregoing, magnesium together with cerium confers enhanced malleability to the alloy under consideration in contrast to magnesium or cerium singularly. Moreover, it has been further found that in terms of deoxidation the combined presence of these two constituents renders cerium recovery easier to control since it has better solubility in the liquid metal than magnesium.

Regarding other constituents the sulfur should run upwards of 0.01%, e.g., 0.02% and up to 0.075%. There is no necessity in utilizing higher sulfur levels. While the invention is primarily directed to nickel-base, copper-containing alloys, for example e.g., 20 to 40% copper, it is deemed that alloys containing 10 to 50% nickel with copper being the balance would also benefit from the co-presence of cerium and magnesium.

Carbon, manganese, silicon and iron, elements often found in nickel-copper (and copper-nickel) alloys, can be present in amounts up to 0.3%, 2.5%, 1% and 5%, respectively.

A most satisfactory alloy contains 25 to 35% copper, 0.02 to 0.06% sulfur, 0.01 to 0.03% cerium, 0.015 to 0.05% magnesium, up to 0.2% carbon, up to 2% manganese, up to 0.5% silicon, up to 2.5% iron, balance essentially nickel.

To give those skilled in the art a better understanding of the invention the following information is given:

EXAMPLE I

A 30,000 pound commercial size heat (approximately 0.028 Mg, 0.01 Ce, 32.6 Cu, 0.12 C, 1.04 Mn, 0.02 Si, 1.32 Fe, bal. Ni) was air induction melted and cast into 3 20"×20×90" ingots which were then heated to about 2100° F. and rolled to billets which were cut into 6 pieces 6"×8" per ingot. The billets were ground and rolled to 0.707 inch rod (coiled). Hexagonal nuts were produced therefrom on a commercial nut-making machine. The hexagonal nuts so produced were found most satisfactory in comparison with similar alloys devoid of cerium (Example III).

EXAMPLE II

A 70,000 lb. commercial size heat was electric arc melted and processed as in Example I. Again, the hexagonal nuts produced were found quite satisfactory. The alloy so produced contained (ladle analysis) 0.024% magnesium, 0.012% cerium, 0.027% sulfur, 30.75% copper, 0.14% carbon, 0.93% manganese, 0.13% silicon, 1.39% iron and the balance nickel and impurities.

EXAMPLE III

Two 70,000 lb. commercial size heats processed as in Examples I and II did exhibit an undue and unsatisfactory amount of cracking in the production of hexagonal nuts, neither alloy composition containing cerium. The compositions of these alloys were as follows:

Mg—0.054 and 0.093
Ce—none added
S—0.045 and 0.048
Cu—30.18 and 32.09
C—0.15 and 0.15
Mn—1.05 and 1.03
Si—0.19 and 0.39
Fe—1.58 and 1.59
Ni—balance

EXAMPLE IV

A series (3) of 50 lb. laboratory size heats were also prepared principally to assess malleability. In one instance magnesium was omitted. The chemistries are give below:

| | Alloy A | Alloy B | Alloy C |
|---|---|---|---|
| Mg | none added | 0.062 | 0.026 |
| Ce | 0.026 | 0.051 | 0.024 |
| S | 0.05 | 0.057 | 0.061 |
| Cu | 32.48 | 32.40 | 32.44 |
| C | 0.16 | 0.17 | 0.17 |
| Mn | 0.97 | 0.98 | 0.98 |
| Si | 0.01 | 0.01 | 0.01 |
| Fe | 1.31 | 1.30 | 1.30 |

Note:
Ce = s amount added.

Alloys A, B and C were heated to 2050° F. and hot worked (forged) to 2"×2" bar which was then forged and cut to ½"×1"×6" lengths. Alloy "A", no magnesium addition, severely cracked on forging and was not further tested. Using a 180° bend test at various temperatures over a test range of 1300° to 2200° F. it was found that Alloy "B", while it forged satisfactorily, was lacking in good malleability whereas Alloy "C" performed very well. It is deemed that the level of the cerium addition in "B", 0.051%, was excessive for good malleability. As indicated previously herein, cerium should preferably be held to 0.05% or less. It might be added that the bend test temperature range was selected to assess workability and with the view that "splitting" would be likely induced. Alloys B and C manifested a much greater degree of resistance to splitting then might have been otherwise expected.

The alloy of the present invention can be used in a number of applications, including water meter components, screw machine products, valve seat inserts, etc. It is deemed particularly useful in the fastener field, e.g., for producing nuts where cold working is a critical processing step.

Although the present invention has been described in conjunction with preferred embodiments, it is to be understood that modifications and variations may be made without departing from the spirit and scope of the invention as those skilled in the art will understand. In this connection it is deemed that the co-addition of cerium and magnesium can be made in alloys in general, irrespective of the nickel and copper contents, assuming, of course, that excessive plasticity and cracking upon working would otherwise be a problem. The cerium can be added, as will be recognized by the artisan, in the form of mischmetal containing about 50% cerium and balance other rare earths. If the cerium content of the mischmetal varies greatly from 50%, adjustments have to be made to compensate for the effect of other rare earths.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

We claim:

1. A sulfur-containing nickel-copper alloy characterized by good machinability, malleability, and resistance to cracking upon working, said alloy consisting (weight percent) about 20% to 40% copper, sulfur from about 0.01% to 0.075%, cerium and magnesium in small but effective amounts sufficient to enhance resistance to cracking with the cerium and magnesium each being up to about 0.1%, up to 0.3% carbon, up to about 2% of manganese, up to 1% silicon, up to 5% iron, and the balance essentially nickel.

2. An alloy in accordance with claim 1 containing about 25 to 35% copper.

3. An alloy in accordance with claim 1 containing about 0.01% to 0.05% cerium and 0.02% to 0.05% magnesium.

4. A fastener made of the alloy set forth in claim 1.

5. A sulfur-containing nickel-copper alloy characterized by good machinability but which is subject to excesive cracking upon hot and/or cold working in the absence of the co-presence of cerium and magnesium, said alloy consisting about 0.005% to 0.1% cerium, 0.01 to 0.1% magnesium, 10% to 50% nickel and the balance essentially copper, said alloy being further characterized by good malleability by reason of the co-presence of cerium and magnesium.

* * * * *